US006619524B2

(12) United States Patent
Daret

(10) Patent No.: US 6,619,524 B2
(45) Date of Patent: Sep. 16, 2003

(54) TICKET DISPENSER DEVICE

(75) Inventor: Dominique Daret, Montrouge (FR)

(73) Assignee: Axiohm, Montrouge (FR)

( * ) Notice: Subject to any disclaimer, the term of this patent is extended or adjusted under 35 U.S.C. 154(b) by 39 days.

(21) Appl. No.: 10/038,672

(22) Filed: Jan. 8, 2002

(65) Prior Publication Data

US 2003/0127485 A1 Jul. 10, 2003

(51) Int. Cl.[7] ..... B26F 3/02
(52) U.S. Cl. ..... 225/21; 225/23
(58) Field of Search ..... 225/21, 23, 24, 225/88, 20, 22

(56) References Cited

U.S. PATENT DOCUMENTS 2,344,340 A * 3/1944 Adams ..... 53/592
2,463,445 A * 3/1949 Van Cleef ..... 225/21
2,506,504 A * 5/1950 Hudson ..... 225/21
3,452,511 A * 7/1969 Hoffler ..... 53/219
3,470,781 A * 10/1969 Domeny ..... 83/436.9
6,152,344 A * 11/2000 Jensen ..... 225/12

* cited by examiner

*Primary Examiner*—Kenneth E. Peterson
(74) *Attorney, Agent, or Firm*—Young & Thompson

(57) ABSTRACT

A device for dispensing tickets from a continuous strip of paper, the device comprising a mechanism for pinching the paper, a cutter blade extending substantially across the strip and having a cutting edge against which the strip bears, the cutting edge of the blade intersecting the plane of the strip of paper coming into contact with the blade before cutting starts, and a support element for supporting the strip between the pinch mechanism and the cutter blade. In the device, the support element also comprises a flap hinged about a fixed axis, the surface of the flap being of a shape such that after about half of the cut has been achieved, the zone of contact between the flap and the strip remaining to be cut moves away from the blade as cutting progresses.

3 Claims, 1 Drawing Sheet

TICKET DISPENSER DEVICE

The present invention relates to a ticket dispenser device, each ticket being constituted by a separate segment of a continuous strip of paper.

More precisely, the device of the invention is associated with a machine for printing such a ticket which constitutes a receipt or written record of a transaction such as a payment by means of a credit card. Still more precisely, a particular application of the device lies in being associated with a thermal printer.

BACKGROUND OF THE INVENTION

There are two main varieties of ticket dispensing machine: those in which the ticket is presented to the user in a detached state or pre-detached from the strip from which it was made; and those in which a ticket is presented while still attached to the strip, with the ticket then being detached from the strip by applying traction thereto causing it to pass over the sharp edge of a cutter blade. Machines using the second technique present the advantage of a static cutter without any moving parts, thereby simplifying maintenance and operating without any need for power to move the moving cutter blade. In contrast, their drawback lies in the absence of a line of cut on the ticket which is clean and precise. The line of cut is often a perforated edge or a slanting edge when the tape is torn rather than cut on the blade. If the blade has a knife edge instead of teeth, then the difficulty lies in starting a cut cleanly and independently of the amount of traction force applied to the ticket by the user.

The state of the art in this field comprises devices in which the blade is V-shaped with a central point on which the cut is started when the user pulls on the paper. Nevertheless, such a blade is complex and expensive to manufacture.

Proposals have recently been made to replace the blade with a V-shaped cutting edge by means of a blade in which the cutting edge is rectilinear and intersects the plane of the strip of paper (which is assumed to be horizontal), and which thus possesses a high point and a low point such that when traction is applied to the strip, it first makes contact with the blade on the side of the strip that is adjacent to the high point of the blade and the traction force is concentrated at this point so as to generate a clean start to the cut.

In general, dispenser devices have guide means or means for supporting the leading edge of the strip upstream from the cutter blade so that when the strip is propelled by a drive mechanism (belonging in numerous applications to a printer), said leading edge can pass over the blade. In the recent development set out above, the guide or support is formed by a wall that moves between a high position in which the leading edge of the strip can pass over the high point of the cutting edge and a low position which is situated level with the low point of the cutting edge. This displacement is obtained under the effect of the traction force the user of the ticket applies to the strip, causing cutting to take place and acting against a return spring which tends to return the moving wall to its high position. The moving wall can be in the form of a hinged flap.

In the application of the invention to delivering a printed ticket, it is desirable to minimize paper consumption. Unfortunately, for a given printout, the amount of paper consumed increases or decreases depending on the extent to which the unprinted portion of the ticket increases or decreases. This unprinted portion depends solely on the distance along the path followed by the paper between the printer (the line of heater points of a thermal printer) and the cutter blade. One of the problems to be solved is that of minimizing this distance while conserving a line of cut that is of excellent quality.

OBJECTS AND SUMMARY OF THE INVENTION

To resolve these problems, the present invention provides a device for dispensing tickets from a continuous strip of paper, each ticket being formed by an end segment of the strip suitable for being grasped by a user of the ticket and detached by the user pulling on said end, the device comprising: a mechanism for pinching the paper along a line extending across the strip; a cutter blade extending substantially across the strip so that the strip bears against a cutting edge of the blade when the above-specified traction is applied thereto, the cutting edge of the blade being formed by a straight line segment that intersects the plane of the strip of paper, which plane contains the pinch line and is in contact with the blade prior to the start of cutting; the device also comprising a support and guide element for supporting and guiding the strip between the pinch mechanism and the cutter blade, the element presenting a surface defined by an edge close to the blade and an edge close to the pinch mechanism, the element being movable between a first position in which the edge of its surface close to the blade is situated entirely above the cutting edge of said blade, and a second position in which said edge is situated entirely below said cutting edge, with a return member urging the guide element towards its first position; in which device the support and guide element is in the form of a flap hinged about a fixed axis substantially parallel to the pinch line, situated beside the edge of the element that is close to the pinch line and extending in the vicinity of the plane containing the pinch line and the midpoint of the cutting edge of the blade, while the surface of the flap is of a shape such that about halfway through cutting the zone of contact between the flap and the strip that remains to be cut moves away from the blade as cutting progresses.

Such a flap presents several advantages, in particular when the cutter blade is relatively close to the strip pinch line. Under such circumstances, the position of the hinge axis of the flap as specified above makes it possible to optimize the size of the flap and to balance its movement between the high point and the low point of the blade. In addition, since the blade is close to the pinch line, a secondary problem arises which is the way the angle made by the strip as it passes over the blade varies significantly along the cutting edge under the effect of the traction applied by the user of the ticket. This angle is relatively small at the high point of the cut and it opens out quickly so as to become very obtuse at the low point, thereby putting the paper into conditions that are most unfavorable for obtaining a proper line of cut. In addition, in the vicinity of the low point, the paper opposes little resistance to the traction force since its uncut width has already been greatly reduced and it becomes sensitive to the force exerted thereon by the hinged guide flap. Because of the way the contact area between the flap and the paper varies when the cut comes closer to the low point of the blade, the flap of the invention presents the advantage of not being a factor contributing to opening the angle in the vicinity of said cutting low point, in the manner mentioned above.

According to another characteristic of the invention, the cutter blade is plane and slopes in such a manner that the edge of the flap close to the cutter blade is closest to said blade in its first position. This disposition makes it possible to eliminate any risk of the leading edge of a strip of paper becoming inserted in untimely manner between the flap and the blade when the strip begins to advance, which could lead to a paper jam.

Finally, the rectilinear cutting edge of the blade slopes relative to the plane containing the pinch line and the axis of the flap at an angle lying in the range 8° to 12°. This angle, which is preferably about 11°, is a compromise value found by experiment, and it makes it possible to cut the ticket under the least possible traction without the paper sliding towards the low point without being cut. Such sliding could lead only to the paper being crumpled prior to cutting which would impede proper issuing of the following ticket.

BRIEF DESCRIPTION OF THE DRAWING

Other characteristics and advantages of the invention appear from the following description given purely by way of indication and relating to an embodiment of a device for dispensing printed tickets.

Reference is made to the accompanying drawing in which:

FIG. 2 is a section view close to the end of the cut showing the device in its state at the end of a cutting operation.

MORE DETAILED DESCRIPTION

Figure 1:
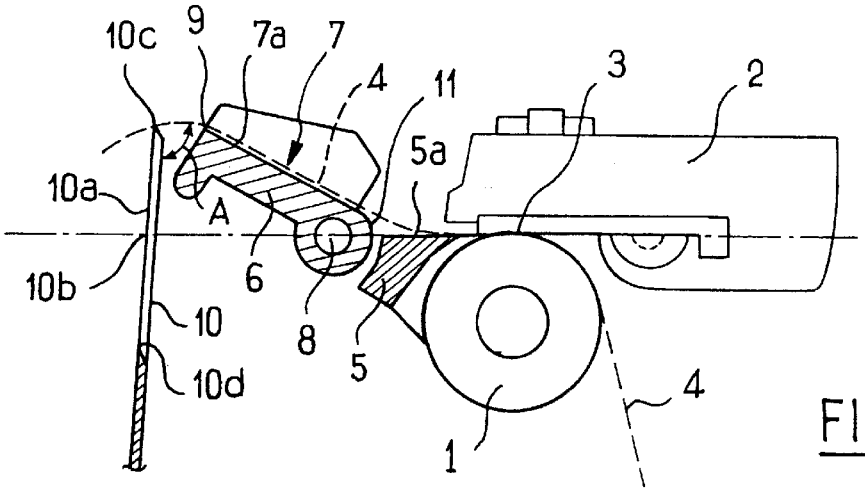
FIGS. 1 and 2 are two diagrammatic views of the device of the invention, FIG. 1 being a section view in the vicinity of the start of cutting showing the device in its state after a ticket has been printed but before cutting has started.

In conventional manner, a thermal printer comprises a paper drive roller 1 (known as a capstan) which is motor driven by means that are not shown and which has a print head 2 bearing there against via a row of heater points 3. The roller drives the paper 4 to be printed under the line of heater points 3 with a resilient return device maintaining the pressure of the head 2 against the capstan 1 thus defining a pinching mechanism.

On leaving the printer, the paper is supported and guided by the top surface 5*a* of a spacer piece 5 forming part of the structure of the device, thus enabling the paper to reach and slide over the top surface 7 of a flap 6 hinged to the structure of the mechanism immediately behind the support piece 5. The hinge axis 8 of the flap 6 is situated in the plane of the guide surface 5*a* and is substantially parallel either to the line of heater points, or to the axis of the capstan 1. The flap 6 has an end edge 9 adjacent to a cutter blade 10 and another edge 11 substantially parallel to the edge 9 an adjacent to the paper support piece 5.

The cutter blade 10 is parallel to the line of heater points and to the axis 8 about which the flap is hinged relative to the structure of the device. The cutter blade has a sharp edge (or cutting edge) 10*a* which intersects the plane of the surface 5*a* and thus the plane which contains the strip of paper on leaving the printer.

The cutter blade 10 is placed in such a manner that its cutting edge 10*a* has a midpoint 10*d* in the guide plane 5 which contains the axis 8. Thus, half of the cutting edge lies above the plane and contains the top cutting point 10*c* where cutting is started when a user of the device pulls on the end of the strip presented to the user. The other half of the cutting edge lies below the plane and contains the bottom cutting point 10*d* at the location where cutting comes to an end at the side of the strip opposite from the side where cutting is started. Finally, this blade 10 is shown as being sloping towards the flap. In other words the plane containing the axis 8 and the line 3 of heater points is not perpendicular to the cutter blade so that the top half of the cutting edge 10*a* of the blade is closest to the flap when the flap is in its state shown in FIG. 1, i.e. before cutting starts.

Figure 2:
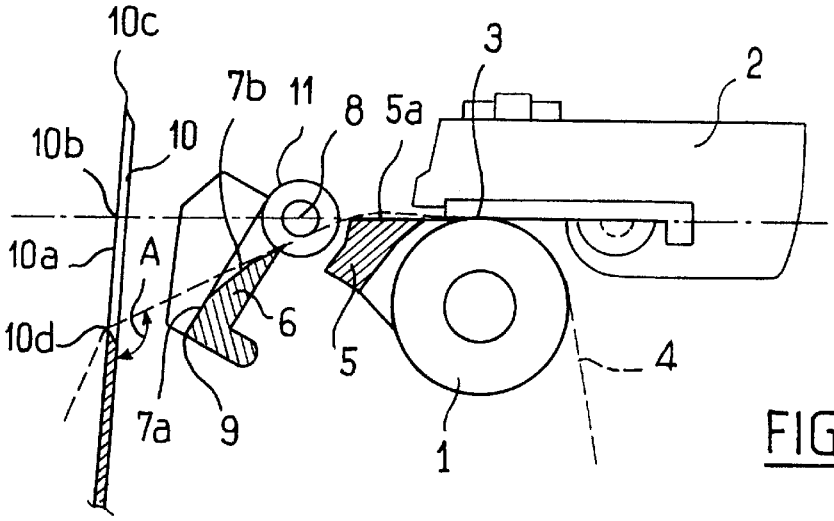
Figure 3:
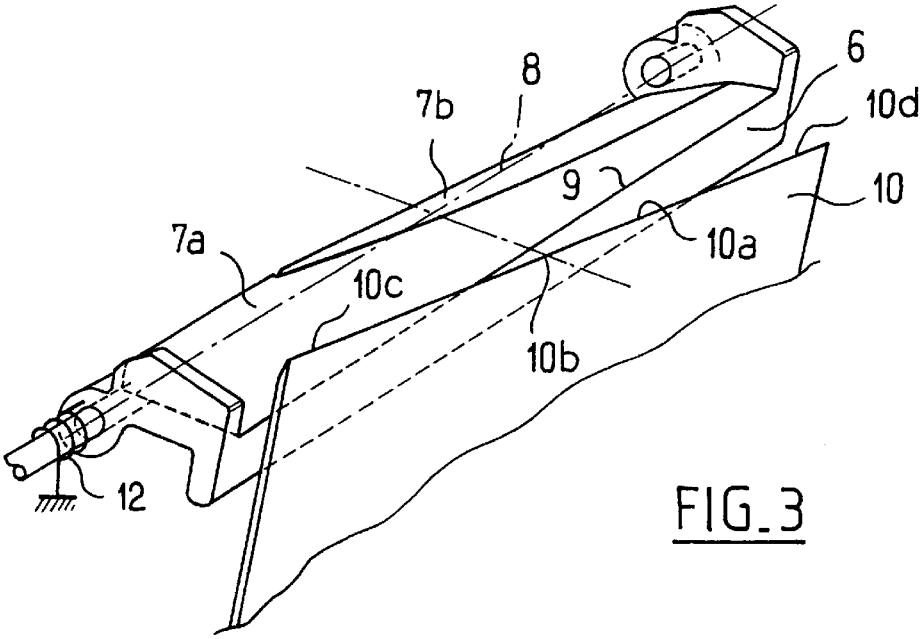
FIG. 3 is a perspective view of the flap used in the device and its location relative to the cutter blade.

The top surface 7 of the flap has two portions 7*a* and 7*b*. The portion 7*a* is the portion in contact with the strip of paper at the beginning of cutting until cutting reaches the vicinity of the point 10*b* in the middle of the cutting edge of the blade 10. This portion 7*a* of the surface 7 is substantially a plane surface passing above the axis 8. On reaching approximately the middle of the line of cut, the strip of paper 4 tensioned by the user begins to bear against the portion 7*b* of the surface which is shaped as a kind of chamfer on the flap, enabling the paper which bears against it to pass progressively below the hinge axis 8. In this configuration, as shown in FIG. 2, it can be seen that the contact between the flap and the strip 4 of paper moves away from the cutter blade as the cut advances. This disposition makes it possible to reduce the extent to which the paper is deviated by the flap, since the flap is urged resiliently towards its position shown in FIG. 1 by a return spring represented diagrammatically at 12 in FIG. 3. The flap 6 urges the paper upwards with a force that increases as the spring 12 is compressed. This force thus tends to raise the paper and open out the angle A, thereby affecting the quality of cutting, particularly in the second half of the cut. It can be seen in FIG. 2 that this angle A is kept smaller by the point of contact between the flap and the paper being kept remote from the blade. The zone 7*b* of the top surface of the flap 6 is shaped so as to make this possible, and also so as to ensure that the flap is practically completely retracted at the end of cutting so as to be able to take advantage of a minimum value for the angle A as imposed by the structure of the device (i.e. by the position of the cutting edge of the blade relative to the outlet from the guide surface 5*a*, for example).

What is claimed is:

1. A device for dispensing tickets from a continuous strip of paper, each ticket being formed by an end segment of the strip suitable for being grasped by a user of the ticket and detached by the user pulling on said end, the device comprising:

a mechanism for pinching the paper along a line extending across the strip;

a cutter blade extending substantially across the strip so that the strip bears against a cutting edge of the blade when the above-specified traction is applied thereto, the cutting edge of the blade being formed by a straight line segment that obliquely intersects the plane of the strip of paper, which plane contains the pinch line and is in contact with the blade prior to the start of cutting; and a support and guide element for supporting and guiding the strip between the pinch mechanism and the cutter blade, the element presenting a surface defined by an edge close to the blade and an edge close to the pinch mechanism, the element being movable between a first position in which the edge of its surface close to the blade is situated entirely above the cutting edge of its surface close to the blade of said blade, and a second position in which said edge is situated entirely below said cutting edge, with a return member urging the guide element towards its first position, wherein the support and guide element is in the form of a flap hinged about a fixed axis substantially parallel to the pinch line, situated beside the edge of the element that is close to the pinch line and extending in the vicinity of the plane containing the pinch line and the midpoint of the cutting edge of the blade, and wherein the surface of the flap is of a non-planar shape having a non-uniform cross-section such that about halfway through cutting and thereafter the zone of contact between the flap and the strip that remains to be cut moves away from the blade as cutting progresses.

2. A device according to claim 1, wherein the cutter blade is plane and slopes in such a manner that the edge of the flap adjacent to the cutter blade is closest to said blade when it is in its first position.

3. A device according to claim 1, wherein the rectilinear cutting edge of the blade slopes relative to the plane containing the pinch line and the axis of the flap at an angle lying in the range 8° to 12°.

* * * * *